US010443554B2

(12) United States Patent
Nankou et al.

(10) Patent No.: US 10,443,554 B2
(45) Date of Patent: Oct. 15, 2019

(54) FUEL INJECTION PUMP

(71) Applicant: YANMAR CO., LTD., Osaka-shi, Osaka (JP)

(72) Inventors: Masaki Nankou, Osaka (JP); Ryota Iwano, Osaka (JP); Isao Takagishi, Osaka (JP)

(73) Assignee: YANMAR CO., LTD., Osaka (JP)

( * ) Notice: Subject to any disclaimer, the term of this patent is extended or adjusted under 35 U.S.C. 154(b) by 287 days.

(21) Appl. No.: 15/025,938

(22) PCT Filed: Sep. 10, 2014

(86) PCT No.: PCT/JP2014/073866
§ 371 (c)(1),
(2) Date: Mar. 30, 2016

(87) PCT Pub. No.: WO2015/045858
PCT Pub. Date: Apr. 2, 2015

(65) Prior Publication Data

US 2016/0237967 A1 Aug. 18, 2016

(30) Foreign Application Priority Data

Sep. 30, 2013 (JP) ..... 2013-204676

(51) Int. Cl.
*F02M 59/36* (2006.01)
*F04B 49/22* (2006.01)
(Continued)

(52) U.S. Cl.
CPC ..... *F02M 59/361* (2013.01); *F02D 1/10* (2013.01); *F02M 59/04* (2013.01); *F02M 59/20* (2013.01);
(Continued)

(58) Field of Classification Search
CPC ..... F04B 19/22; F04B 49/225; F02M 59/34; F02M 59/361; F02M 59/485
See application file for complete search history.

(56) References Cited

U.S. PATENT DOCUMENTS 3,202,161 A * 8/1965 Richards ..... F01M 1/24 123/198 D
3,377,870 A * 4/1968 Miller ..... G05D 13/10 73/543
(Continued)

FOREIGN PATENT DOCUMENTS

CN 2462085 Y 11/2001
CN 2716522 Y 8/2005
(Continued)

OTHER PUBLICATIONS

SIPO Office Action for corresponding CN Application No. 201480053582.8; dated Oct. 16, 2017.
(Continued)

*Primary Examiner* — Christopher S Bobish
(74) *Attorney, Agent, or Firm* — Norton Rose Fulbright US LLP

(57) ABSTRACT

A fuel injection pump includes a plunger, a plunger barrel which supports the plunger, a body which houses the plunger and the plunger barrel, a plate which covers an opening formed on the body, a control lever turnably attached near the plate, and an adjuster bolt which abuts against the control lever to restrict turn of the control lever and is supported by a stay disposed on the plate.

17 Claims, 9 Drawing Sheets

(51) Int. Cl.

| | |
|---|---|
| ***F02M 59/34*** | (2006.01) |
| ***F02M 59/20*** | (2006.01) |
| ***F04B 19/22*** | (2006.01) |
| ***F02M 59/26*** | (2006.01) |
| ***F02M 59/28*** | (2006.01) |
| ***F02D 1/10*** | (2006.01) |
| ***F02M 59/04*** | (2006.01) |
| ***F02M 59/48*** | (2006.01) |
| ***F02D 1/00*** | (2006.01) |

(52) U.S. Cl.

CPC ..... *F02M 59/265* (2013.01); *F02M 59/28* (2013.01); *F02M 59/34* (2013.01); *F04B 19/22* (2013.01); *F04B 49/225* (2013.01); *F02D 2001/007* (2013.01); *F02D 2001/0045* (2013.01); *F02D 2001/0095* (2013.01); *F02M 59/485* (2013.01)

(56) References Cited

U.S. PATENT DOCUMENTS 3,472,126 A * 10/1969 Miller ..... G05D 13/00 91/386
3,613,651 A * 10/1971 Snyder ..... F02D 1/04 123/339.29
3,640,259 A * 2/1972 Garcea ..... F02D 1/00 123/179.15
3,797,470 A * 3/1974 Beck ..... F02D 1/00 123/339.29
3,884,205 A * 5/1975 Staudt ..... F02D 1/025 123/373
4,164,924 A * 8/1979 Makino ..... F02D 1/10 123/374
4,351,293 A * 9/1982 Hewitt ..... F02D 1/02 123/198 D
4,497,295 A * 2/1985 Bruhmann ..... F02D 1/045 123/372
4,570,588 A * 2/1986 Herdin ..... F02M 63/022 123/198 DB
4,604,978 A * 8/1986 Brouwers ..... G05D 13/10 123/369
4,656,980 A * 4/1987 Ohkoshi ..... F02D 1/10 123/179.16
4,754,734 A * 7/1988 Ohkoshi ..... F02D 1/10 123/366
4,819,606 A * 4/1989 Kawano ..... F02D 1/183 123/380
4,887,571 A * 12/1989 Eheim ..... F02D 1/08 123/179.17
5,005,546 A * 4/1991 Mann ..... F02M 3/07 123/339.1
5,193,504 A * 3/1993 Konrath ..... F02D 1/08 123/357

FOREIGN PATENT DOCUMENTS

| | | | |
|---|---|---|---|
| CN | 201835921 | U | 5/2011 |
| CN | 201835922 | U | 5/2011 |
| EP | 1691058 | A1 | 8/2006 |
| GB | 1374220 | A | 11/1974 |
| JP | S58210331 | A | 12/1983 |
| JP | 01066443 | U1 | 4/1989 |
| JP | H05021643 | Y2 | 6/1993 |
| JP | 06067831 | U | 9/1994 |
| JP | H08218899 | A | 8/1996 |
| JP | H08218907 | A | 8/1996 |
| JP | 2003003866 | A | 1/2003 |
| JP | 2012117502 | A | 6/2012 |

OTHER PUBLICATIONS

International Search Report corresponding to Application No. PCT/JP2014/073866; dated Nov. 4, 2014, with English translation.
Supplementary European Search Report corresponding to Application No. 14849762.1-1616/3054130 PCT/JP2014073866; dated Apr. 13, 2017.

* cited by examiner

FUEL INJECTION PUMP

This is the U.S. national stage of application No. PCT/JP2014/073866, filed on Sep. 10, 2014. Priority under 35 U.S.C. § 119(a) and 35 U.S.C. § 365(b) is claimed from Japanese Application No. 2013-204676, filed Sep. 30, 2013, the disclosure of which is also incorporated herein by reference.

TECHNICAL FIELD

The present invention relates to techniques of a fuel injection pump.

BACKGROUND ART

Conventionally, there have been known fuel injection pumps that pressure-feed a fuel to a combustion chamber of a diesel engine (refer to Patent Document 1, for example). Such a fuel injection pump is provided with a control lever capable of adjusting a fuel pressure-feed amount.

When the amount of a fuel supplied from a fuel injection pump is reduced, a diesel engine is stopped due to a reduction in output thereof (called a stall). Thus, in a fuel injection pump, turn of a control lever is restricted by a set bolt to prevent the fuel pressure-feed amount from falling below a limit value.

Further, at present, there is a fuel injection pump that is provided with an adjuster bolt in addition to a set bolt. The adjuster bolt can be freely adjusted by a user differently from the set bolt. Thus, the fuel injection pump provided with the adjuster bolt can set any lower limit value of the fuel pressure-feed amount within a range that is not less than a limit value of the fuel pressure-feed amount. However, in such a fuel injection pump, it is necessary to modify a body thereof for the attachment of the adjuster bolt. Thus, it is difficult to achieve such a fuel injection pump.

PRIOR ART DOCUMENT

Patent Document

Patent Document 1: JP 2012-117502 A

SUMMARY OF THE INVENTION

Problem to be Solved by the Invention

It is an object of the present invention to provide a fuel injection pump that is provided with an adjuster bolt and a body with no modification applied.

Solutions to Problem

A fuel injection pump according to a first aspect of the present invention includes:

a plunger;

a plunger barrel configured to support the plunger;

a body configured to house the plunger and the plunger barrel;

a plate configured to cover an opening formed on the body;

a control lever turnably attached near the plate; and an adjuster bolt configured to abut against the control lever to restrict turn of the control lever, the adjuster bolt being supported by a stay disposed on the plate.

According to a second aspect of the present invention, in the fuel injection pump according to the first aspect, the stay is formed separately from the plate and fixed to the plate.

According to a third aspect of the present invention, in the fuel injection pump according to the first aspect, the stay is formed by bending a part of the plate.

According to a fourth aspect of the present invention, in the fuel injection pump according to the first to third aspects, the control lever is formed by punching, and the adjuster bolt abuts against a shear plane of the control lever.

Effects of the Invention

The present invention achieves the following effects.

According to the first aspect of the present invention, the adjuster bolt is supported by the stay disposed on the plate. Accordingly, since it is not necessary to modify the body for the attachment of the adjuster bolt, the fuel injection pump can be easily achieved. Further, change to this specification can be achieved merely by replacement to the plate with the stay disposed thereon. Thus, even when a fuel injection pump provided with no adjuster bolt and a fuel injection pump provided with the adjuster bolt are manufactured at the same time, no confusion occurs in the manufacture site. Further, the difference is only in the plate, and the other components are common. Thus, the number of components is not increased.

According to the second aspect of the present invention, the stay is formed separately from the plate and fixed to the plate. Accordingly, in the fuel injection pump, there is no step of bending the plate to form the stay. Thus, the manufacturing process can be simplified. Further, the simplified manufacturing process enables a reduction in the manufacturing cost.

According to the third aspect of the present invention, the stay is formed by bending a part of the plate. Accordingly, in the fuel injection pump, there is no step of forming the stay separately from the plate and fixing the stay to the plate. Thus, the manufacturing process can be simplified. Further, the simplified manufacturing process enables a reduction in the manufacturing cost.

According to the fourth aspect of the present invention, the adjuster bolt abuts against the shear plane of the control lever. Accordingly, in the fuel injection pump, the control lever is common regardless of the presence or absence of the adjuster bolt. Thus, the number of components can be reduced. Further, the reduction in the number of components enables a reduction in the manufacturing cost. Further, since the shear plane has a high hardness due to a residual stress, the strength can be easily ensured.

EMBODIMENT OF THE INVENTION

Next, an embodiment of the present invention will be described.

First, the configuration of a fuel injection pump 100 will be described.

Figure 1:
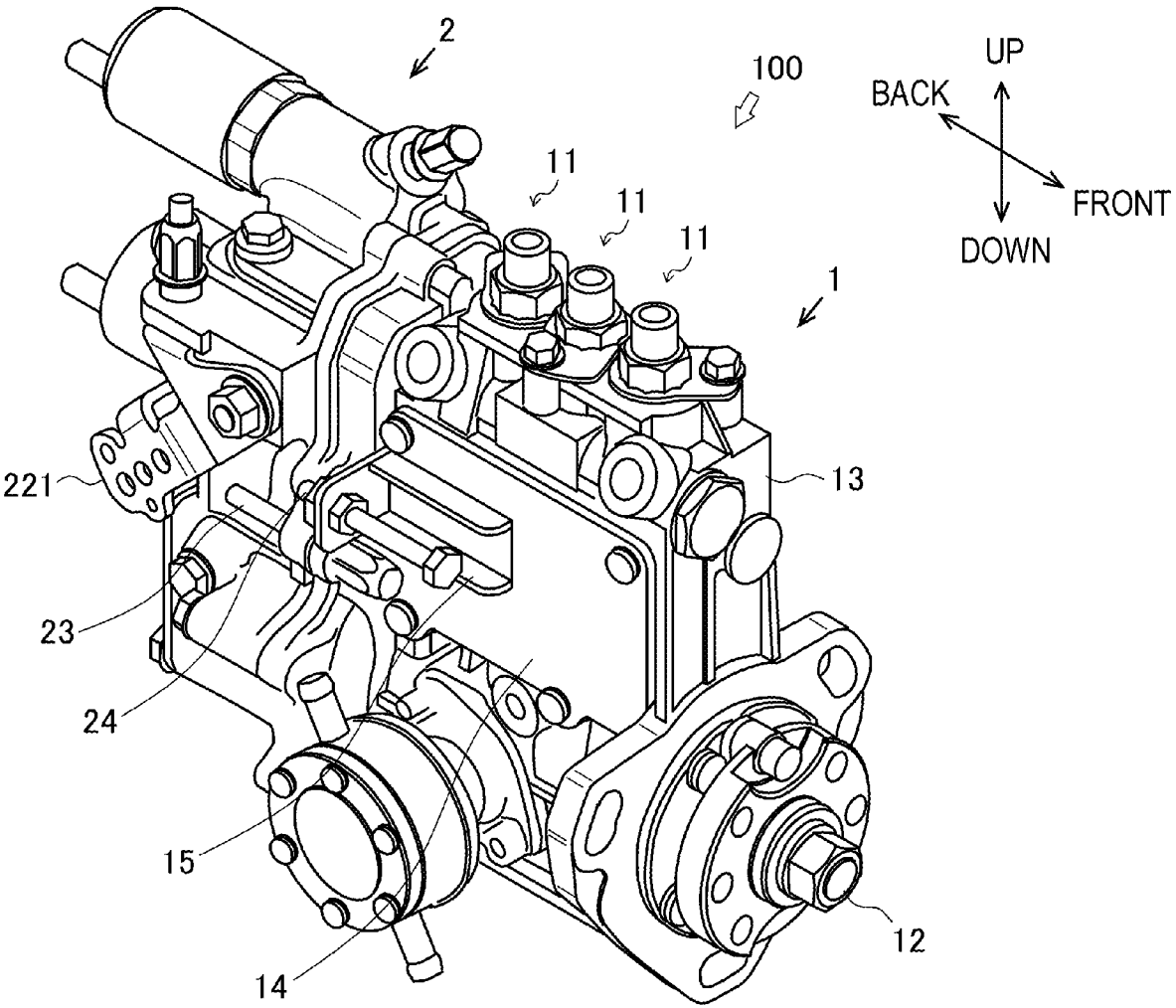
FIG. 1 is a perspective view showing the configuration of a fuel injection pump.
Figure 2:
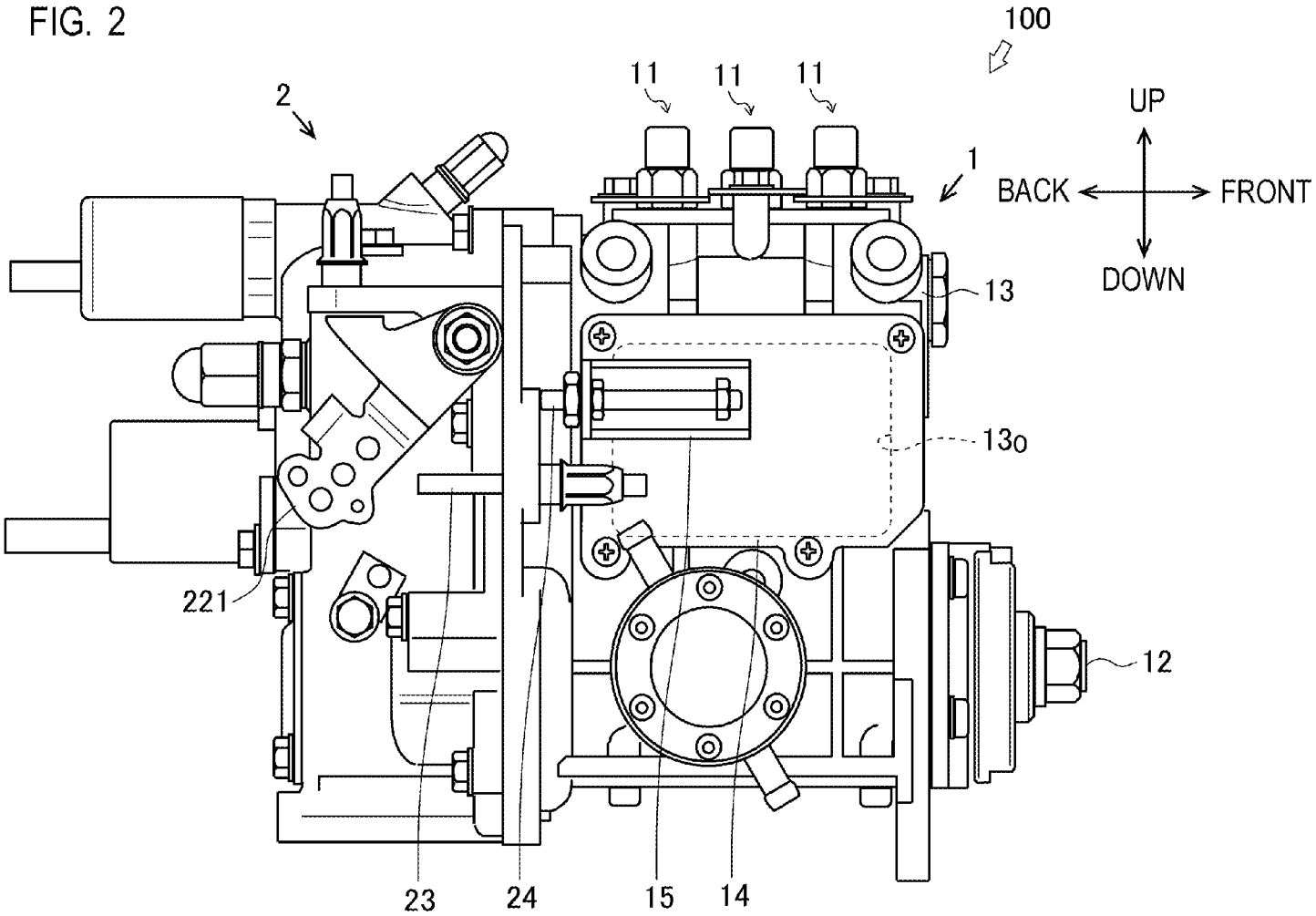
FIG. 2 is a side view showing the configuration of the fuel injection pump.
Figure 3:
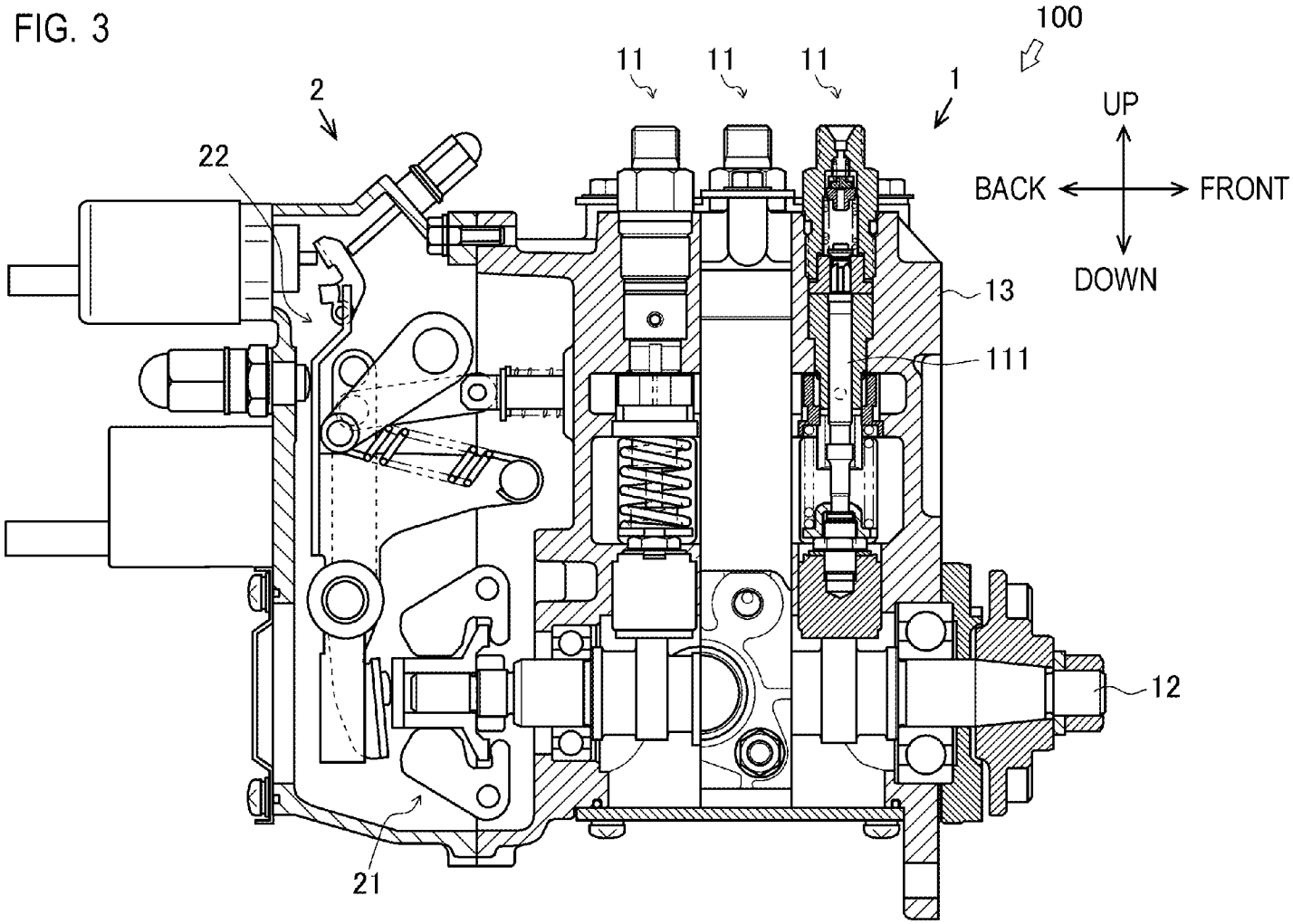
FIG. 3 is a sectional view showing the configuration of the fuel injection pump.

FIGS. 1 to 3 show the configuration of the fuel injection pump 100. FIG. 1 is a perspective view of the fuel injection pump 100. FIG. 2 is a side view of the fuel injection pump 100. FIG. 3 is a sectional view of the fuel injection pump 100. In FIGS. 1 to 3, up and down directions and front and back directions are indicated.

The fuel injection pump 100 mainly includes a pressure-feed device 1 and a speed governing device 2.

The pressure-feed device 1 pressure-feeds a fuel. The pressure-feed device 1 mainly includes a fuel pressure-feed mechanism 11 and a cam shaft 12. The fuel injection pump 100 is mounted on an in-line three-cylinder diesel engine and thus provided with three fuel pressure-feed mechanisms 11. Each of the fuel pressure-feed mechanisms 11 is driven by the cam shaft 12. Specifically, a plunger 111 of the fuel pressure-feed mechanism 11 is slid by the cam shaft 12 (refer to FIG. 4(B)).

The speed governing device 2 adjusts a fuel pressure-feed amount. The speed governing device 2 mainly includes a governor mechanism 21 and a link mechanism 22. The governor mechanism 21 drives the link mechanism 22 on the basis of a rotation speed of the cam shaft 12. The link mechanism 22 drives the fuel pressure-feed mechanism 11 in response to input from the governor mechanism 21 or an operation of a user. Specifically, the plunger 111 of the fuel pressure-feed mechanism 11 is turned by the governor mechanism 21 and the link mechanism 22 (refer to FIG. 4(B)).

Next, the structure and operation mode of the fuel pressure-feed mechanism 11 will be described.

Figure 4B:
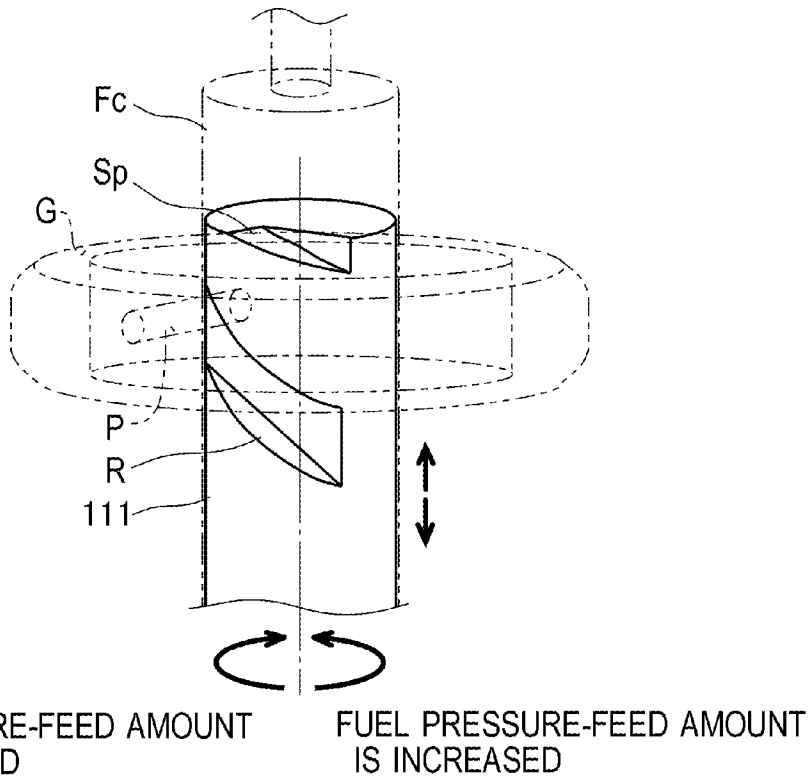
FIG. 4(B) is a diagram showing the structure of a plunger and the vicinity thereof.
Figure 4A:
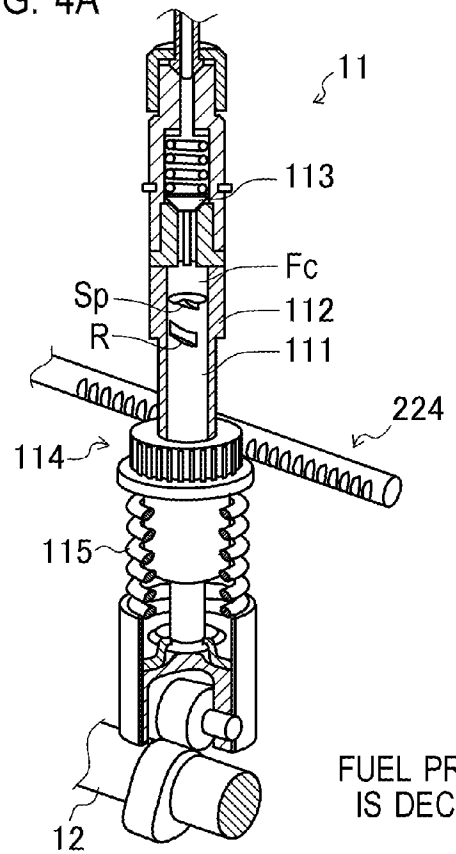
FIG. 4(A) is a diagram showing the structure of a fuel pressure-feed mechanism.

FIG. 4(A) shows the structure of the fuel pressure-feed mechanism 11. FIG. 4(B) shows the structure of the plunger 111 and the vicinity thereof. Arrows in FIG. 4(B) indicate operation directions of the plunger 111.

As shown in FIG. 4(A), the fuel pressure-feed mechanism 11 mainly includes the plunger 111, a plunger barrel 112, a delivery valve 113, a control sleeve 114, and a spring 115. These components are housed inside a body 13 (refer to FIGS. 1 to 3).

The plunger 111 is supported by the plunger barrel 112. The plunger 111 is biased toward the cam shaft 12 by the spring 115 and slid by the rotation of the cam shaft 12. The control sleeve 114 is externally fitted to the plunger 111 in a midway part in the up-down direction thereof and turns integrally with the plunger 111. A pinion gear which is disposed on the outer periphery of the control sleeve 114 is meshed with a rack gear of a control rack 224 of the link mechanism 22.

The pressure feed of a fuel is started when the plunger 111 slides upward and blocks a port hole P after the fuel is supplied into the plunger barrel 112 from a gallery G. More specifically, the plunger 111 first slides downward, and the fuel is supplied into the plunger barrel 112 from the gallery G through the port hole P. Then, when the plunger 111 slides upward and blocks the port hole P, the fuel cannot escape to the gallery G, and the pressure inside a fuel chamber Fc thereby increases. When the pressure inside the fuel chamber Fc exceeds a predetermined value, the delivery valve 113 is opened to start the pressure feed of the fuel.

The pressure feed of the fuel is finished when a lead groove R formed on the plunger 111 comes into communication with the port hole P. More specifically, when the plunger 111 slides upward and the lead groove R comes into communication with the port hole P, the fuel escapes to the gallery G through the port hole P to reduce the pressure inside the fuel chamber Fc. When the pressure inside the fuel chamber Fc falls below the predetermined value, the delivery valve 113 is closed to finish the pressure feed of the fuel.

Adjustment of the fuel pressure-feed amount is achieved by changing "timing of blocking the port hole P by the plunger 111". More specifically, an inclined plane Sp having a predetermined angle with respect to the up-down direction is formed on the upper end face of the plunger 111. Thus, the "timing of blocking the port hole P by the plunger 111" can be changed by turning the plunger 111. The adjustment of the fuel pressure-feed amount can also be achieved by changing "timing of allowing the lead groove R and the port hole P to communicate with each other". The lead groove R is formed in the midway part of the plunger 111 at a predetermined angle with respect to the up-down direction of the plunger 111. Thus, the "timing of allowing the lead groove R and the port hole P to communicate with each other" can be changed by turning the plunger 111. In this manner, the fuel injection pump 100 adjusts the fuel pressure-feed amount by changing the amount of a fuel that escapes to the gallery G from the inside of the plunger barrel 112 when a fuel supplied into the plunger barrel 112 is pressure-fed by a sliding movement of the plunger 111.

Next, the structure and operation mode of the governor mechanism 21 and the link mechanism 22 will be described.

Figure 5B:
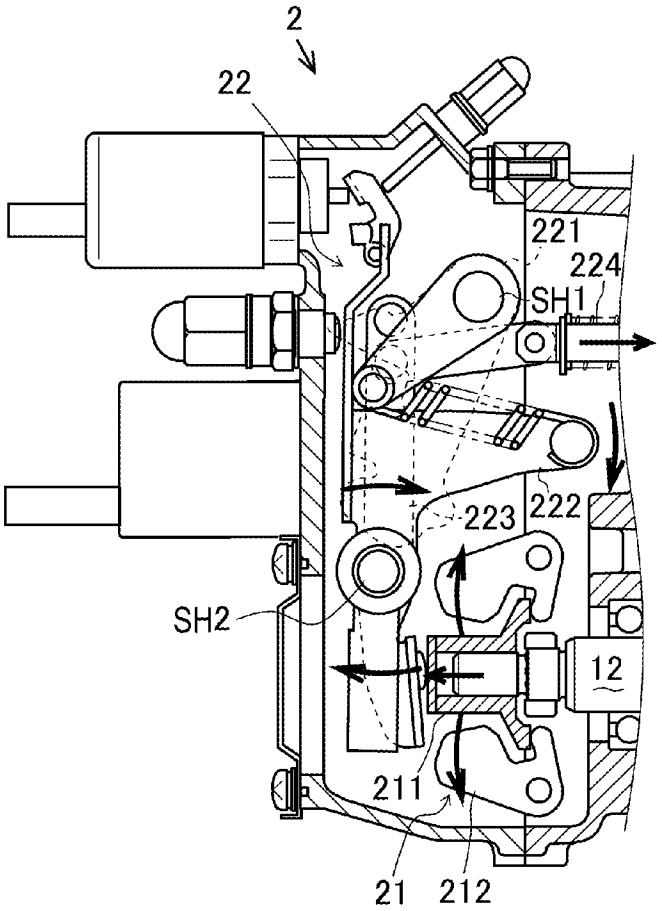
FIG. 5(A) is a diagram showing an operation performed when a fuel pressure-feed amount is increased by a governor mechanism, and FIG. 5(B) a diagram showing an operation performed when the fuel pressure-feed amount is reduced by the governor mechanism.
Figure 5A:
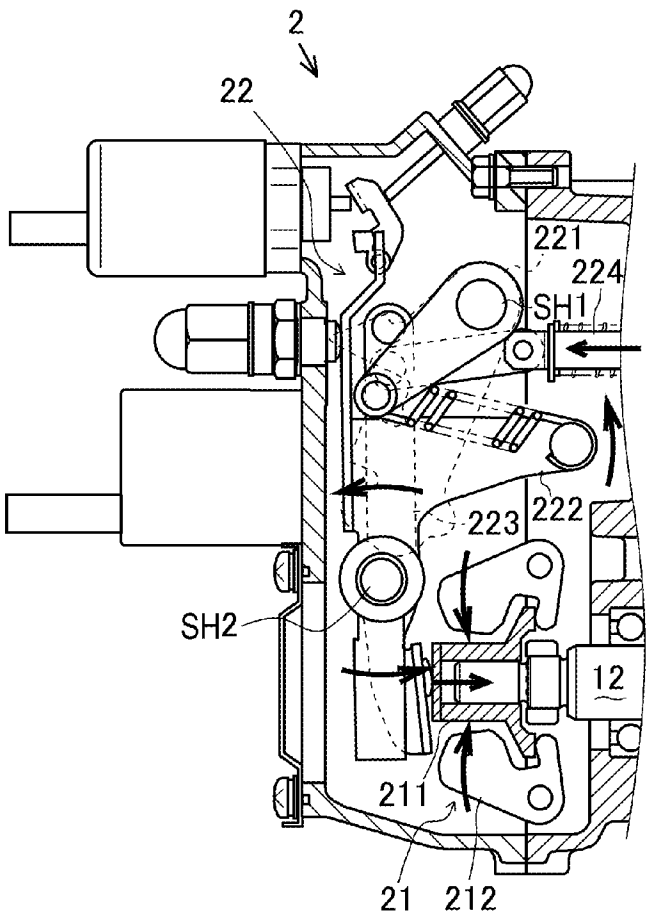

FIG. 5(A) shows an operation performed when the fuel pressure-feed amount is increased by the governor mechanism 21. FIG. 5(B) shows an operation performed when the fuel pressure-feed amount is reduced by the governor mechanism 21. Arrows in FIGS. 5(A) and 5(B) indicate operation directions of members of the governor mechanism 21 and the link mechanism 22.

Figure 6B:
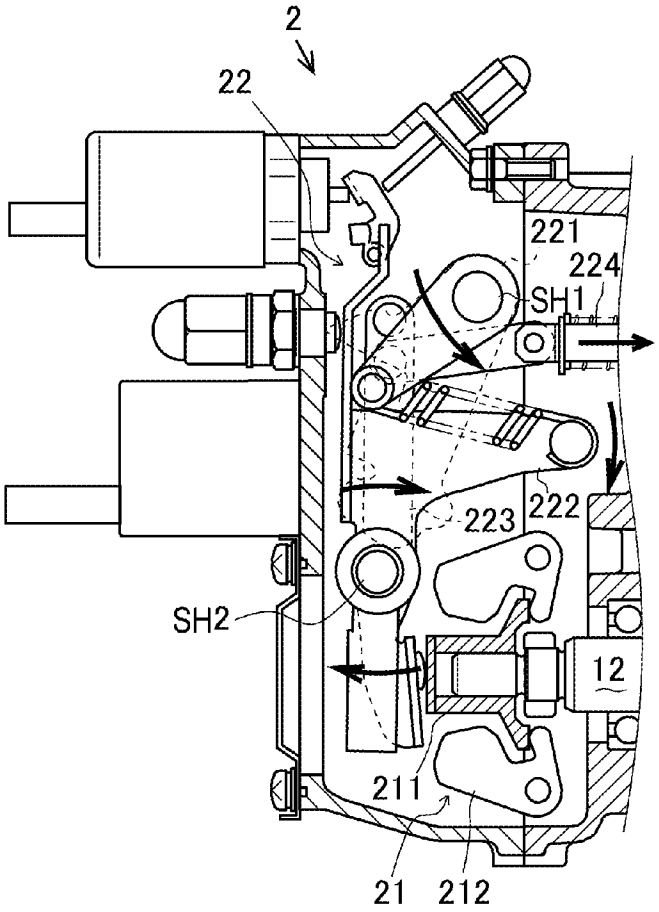
FIG. 6(B) is a diagram showing an operation performed when the fuel pressure-feed amount is reduced by an operation of the control lever.
Figure 6A:
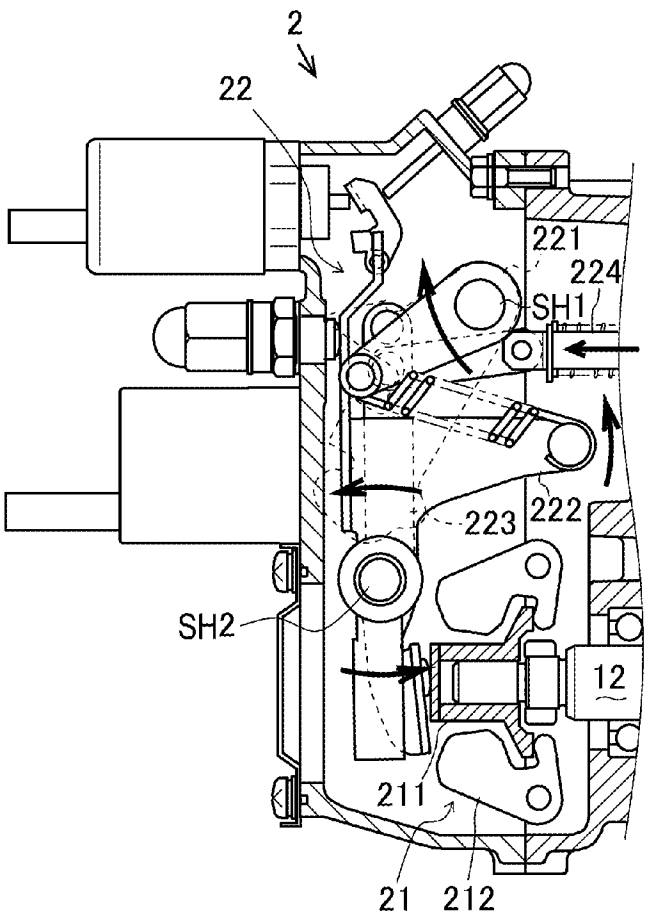
FIG. 6(A) is a diagram showing an operation performed when the fuel pressure-feed amount is increased by an operation of a control lever.

FIG. 6(A) shows an operation performed when the fuel pressure-feed amount is increased by an operation of a control lever 221. FIG. 6(B) shows an operation performed when the fuel pressure-feed amount is reduced by an operation of the control lever 221. Arrows in FIGS. 6(A) and 6(B) indicate operation directions of members of the link mechanism 22.

As shown in FIGS. 5(A) to 6(B), the governor mechanism 21 mainly includes a governor sleeve 211 and governor weights 212. The link mechanism 22 mainly includes the control lever 221, a tension lever 222, a governor lever 223, and the control rack 224.

The governor sleeve 211 is slidably externally fitted to the cam shaft 12. Claws of the governor sleeve 211 are hooked on recesses of the governor weights 212. Thus, when the governor weights 212 turn, the governor sleeve 211 slides in an axial direction of the cam shaft 12. The governor lever 223 abuts against one end of the governor sleeve 211 and thus turns around a turn shaft SH2 in response to the slide of the governor sleeve 211.

The control lever 221 turnably supported around a turn shaft SH1. The control lever 221 is turned by an operation of a user. The tension lever 222 is turnably supported around the turn shaft SH2. The tension lever 222 is coupled to the control lever 221 through a spring and turned by the control lever 221. The governor lever 223 is also turnably supported around the turn shaft SH 2. The governor lever 223 is coupled to the tension lever 222 and turned by the tension lever 222. The control rack 224 is attached to one end of the governor lever 223 through a governor link.

As shown in FIG. 5(A), when the rotation speed of the cam shaft 12 decreases, a centrifugal force acting on the governor weights 212 is reduced. Thus, the governor weights 212 turn to come close to each other. Accordingly, the governor sleeve 211 slides in one direction by the turn of the governor weights 212. Thus, the governor lever 223 is turned to pull the control rack 224. When the plunger 111 is turned by the control rack 224, the fuel pressure-feed amount is increased (refer to FIG. 4(B)).

On the other hand, as shown in FIG. 5(B), when the rotation speed of the cam shaft 12 increases, the centrifugal force acting on the governor weights 212 is increased. Thus, the governor weights 212 turn to move away from each other. Accordingly, the governor sleeve 211 slides in the other direction by the turn of the governor weights 212. Thus, the governor lever 223 is turned to push the control rack 224. When the plunger 111 is turned by the control rack 224, the fuel pressure-feed amount is reduced (refer to FIG. 4(B)).

Such a configuration enables the fuel injection pump 100 to adjust the fuel pressure-feed amount according to the load on the diesel engine.

As shown in FIG. 6(A), when a user turns the control lever 221 in one direction, the tension lever 222 is turned by the control lever 221. Accordingly, since the governor lever 223 is coupled to the tension lever 222, the governor lever 223 is turned together with the tension lever 222 to pull the control rack 224. When the plunger 111 is turned by the control rack 224, the fuel pressure-feed amount is increased (refer to FIG. 4(B)).

On the other hand, as shown in FIG. 6(B), when a user turns the control lever 221 in the other direction, the tension lever 222 is turned by the control lever 221. Accordingly, since the governor lever 223 is coupled to the tension lever 222, the governor lever 223 is turned together with the tension lever 222 to push the control rack 224. When the plunger 111 is turned by the control rack 224, the fuel pressure-feed amount is reduced (refer to FIG. 4(B)).

Such a configuration enables the fuel injection pump 100 to adjust the fuel pressure-feed amount in response to an operation of a user.

Next, a structure for defining a low idle speed will be described.

Figure 7B:
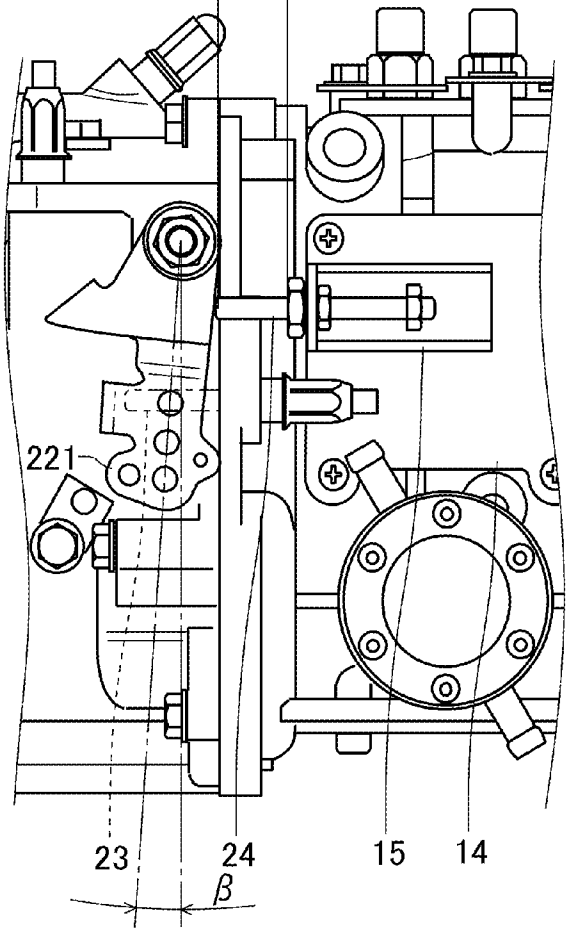
FIG. 7(B) is a diagram showing a state in which an adjuster bolt and the control lever abut against each other.
Figure 7A:
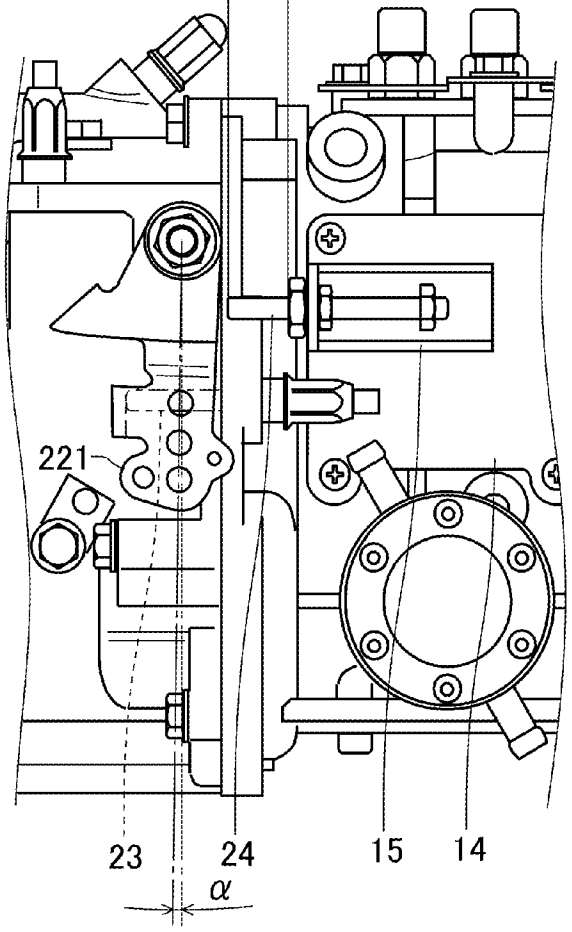
FIG. 7(A) is a diagram showing a state in which a set bolt and the control lever abut against each other.
Figure 8:
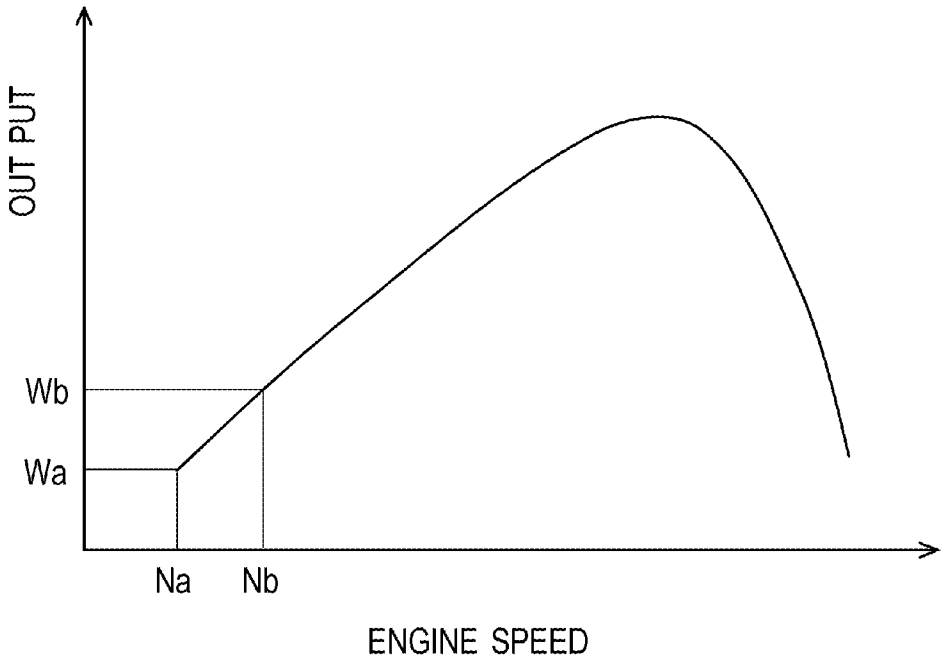
FIG. 8 is a diagram showing an output characteristic of a diesel engine.

FIG. 7(A) shows a state in which a set bolt 23 and the control lever 221 abut against each other. FIG. 7(B) shows a state in which an adjuster bolt 24 and the control lever 221 abut against each other. FIG. 8 shows an output characteristic of the diesel engine.

The fuel injection pump 100 is provided with the adjuster bolt 24 in addition to the set bolt 23. The adjuster bolt 24 is attached to a stay 15 (described below) and adjustable in the front-back direction (refer to FIGS. 1 and 2). At the time of factory shipment (when a user has not adjusted the adjuster bolt 24), the adjuster bolt 24 has a small backward-projecting amount. Here, a projecting amount when the adjuster bolt 24 has not been adjusted is denoted by Da, and a projecting amount when the adjuster bolt 24 has been adjusted is denoted by Db.

As shown in FIG. 7(A), when the adjuster bolt 24 projects by Da, the set bolt 23 abuts against the control lever 221 to restrict the turn of the control lever 221. At this time, a turning angle of the control lever 221 is maintained at $\alpha°$. This means that the turning angle of the control lever 221 becomes $\alpha°$ even when a user does not operate the control lever 221.

The set bolt 23 can be defined as a bolt that defines a limit output of the diesel engine. That is, the set bolt 23 defines a limit value of the fuel pressure-feed amount with which the diesel engine can autonomously drive without a stall. Thus, a user is not allowed to freely adjust the set bolt 23. As shown in FIG. 8, at this time, the engine speed, that is, the low idle speed becomes Na, and the maximum output becomes Wa.

On the other hand, as shown in FIG. 7(B), when the adjuster bolt 24 projects by Db, the adjuster bolt 24 abuts against the control lever 221 to restrict the turn of the control lever 221. At this time, the turning angle of the control lever 221 is maintained at $\beta°$. This means that the turning angle of the control lever 221 becomes $\beta°$ even when a user does not operate the control lever 221.

The adjuster bolt 24 is defined as a bolt that changes a minimum output of the diesel engine. That is, the adjuster bolt 24 adjusts a lower limit value of the fuel pressure-feed amount to change the low idle speed of the diesel engine. Thus, a user is allowed to freely adjust the adjuster bolt 24. As shown in FIG. 8, at this time, the engine speed, that is, the low idle speed becomes Nb, and the maximum output becomes Wb.

Such a configuration enables the fuel injection pump 100 to change the low idle speed of the diesel engine according to an application purpose of the diesel engine.

Next, a characteristic point of the fuel injection pump 100 will be described.

The fuel injection pump 100 includes a plate 14 attached to a side face of the body 13 (refer to FIGS. 1 and 2). The plate 14 is provided for covering an opening 13*o* formed on the body 13 (refer to FIG. 2). The opening 13*o* is required for assembly and disassembly of the fuel pressure-feed mechanism 11 described above.

The plate 14 is cut out from a metal plate material. In the fuel injection pump 100, the stay 15 is disposed on the plate 14 (refer to FIGS. 1, 2, 7(A), and 7(B)). The adjuster bolt 24 is inserted into a hole of the stay 15 and supported in this state.

With such a configuration, the adjuster bolt 24 is supported by the stay 15 disposed on the plate 14. Accordingly, since it is not necessary to modify the body 13 for the attachment of the adjuster bolt 24, the fuel injection pump 100 can be easily achieved. Further, change to this specification can be achieved merely by replacement to the plate 14 with the stay 15 disposed thereon. Thus, even when a fuel injection pump provided with no adjuster bolt 24 and a fuel injection pump provided with the adjuster bolt 24 are manufactured at the same time, no confusion occurs in the manufacture site. Further, the difference is only in the plate 14, and the other components are common. Thus, the number of components is not increased.

The following structures may be applied to the fuel injection pump 100.

Figure 9B:
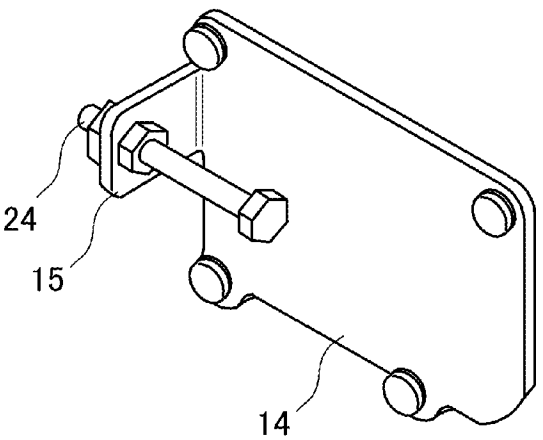
FIG. 9(B) is a diagram showing a structure in which a part of a plate is bent to form a stay.
Figure 9A:
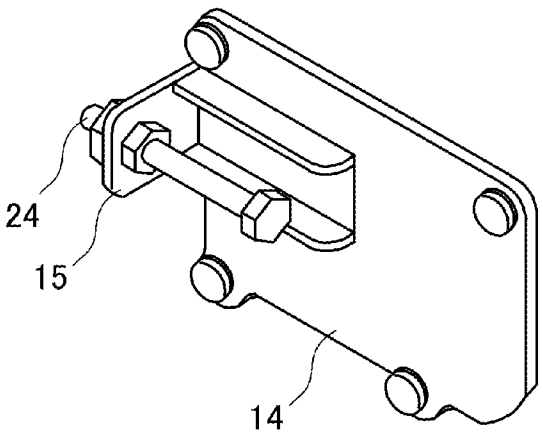
FIG. 9(A) is a diagram showing a structure in which a stay formed separately from a plate is fixed to the plate.

FIG. 9(A) shows a structure in which a stay 15 formed separately from a plate 14 is fixed to the plate 14. FIG. 9(B) shows a structure in which a part of a plate 14 is bent to form a stay 15.

As shown in FIG. 9(A), the stay 15 may be formed separately from the plate 14 and fixed to the plate 14. The stay 15 is formed by bending a metal plate material, and the adjuster bolt 24 is attached to one side of the stay 15. The adjuster bolt 24 is adjustable in the front-back direction by loosening a nut (refer to FIGS. 1, 2, 7(A), and 7(B)).

In this manner, the stay 15 is formed separately from the plate 14 and fixed to the plate 14. Accordingly, in the fuel injection pump 100, there is no step of bending the plate 14 to form the stay 15. Thus, the manufacturing process can be simplified. Further, the simplified manufacturing process enables a reduction in the manufacturing cost.

As shown in FIG. 9(B), the stay 15 may be formed by bending a part of the plate 14. The stay 15 is formed by bending a part of the plate 14, and the adjuster bolt 24 is attached to one side of the stay 15. The adjuster bolt 24 is adjustable in the front-back direction by loosening a nut (refer to FIGS. 1, 2, 7(A), and 7(B)).

In this manner, the stay 15 is formed by bending a part of the plate 14. Accordingly, in the fuel injection pump 100, there is no step of forming the stay 15 separately from the plate 14 and fixing the stay 15 to the plate 14. Thus, the manufacturing process can be simplified. Further, the simplified manufacturing process enables a reduction in the manufacturing cost.

Next, another characteristic point of the fuel injection pump 100 will be described.

In the fuel injection pump 100, the control lever 221 is formed by punching. The adjuster bolt 24 abuts against a shear plane of the control lever 221 (refer to FIGS. 7(A) and 7(B)).

In this manner, the adjuster bolt 24 abuts against the shear plate of the control lever 221. Accordingly, in the fuel injection pump 100, the control lever 221 is common regardless of the presence or absence of the adjuster bolt 24. Thus, the number of components can be reduced. Further, the reduction in the number of components enables a reduction in the manufacturing cost. Further, since the shear plane has a high hardness due to a residual stress, the strength can be easily ensured.

INDUSTRIAL APPLICABILITY

The present invention is applicable to techniques of a fuel injection pump.

DESCRIPTION OF REFERENCE SIGNS

100: Fuel injection pump
1: Pressure-feed device
11: Fuel pressure-feed mechanism
111: Plunger
112: Plunger barrel
113: Delivery valve
114: Control sleeve
115: Spring
12: Cam shaft
13: Body
13*o*: Opening
14: Plate
15: Stay
2: Speed governing device
21: Governor mechanism
211: Governor sleeve
212: Governor weight
22: Link mechanism
221: Control lever
222: Tension lever
223: Governor lever
224: Control rack
23: Set bolt
24: Adjuster bolt

The invention claimed is:

1. A fuel injection pump comprising:
a plunger;
a plunger barrel configured to support the plunger;
a body configured to house the plunger and the plunger barrel;
a plate configured to cover an opening formed on the body;
a control lever turnably attached near the plate and disposed on an external side of the body;
a set bolt configured to abut against the control lever to restrict turn of the control lever in a rotation direction, the set bolt is further configured to define a first value of a lower limit of a fuel pressure feed amount; and
an adjuster bolt supported by a stay disposed on the plate, the adjuster bolt configured to be adjustable to abut against the control lever to restrict turn of the control lever in the rotation direction, the adjuster bolt is adjustable to establish a second value of the lower limit of the fuel pressure feed amount that is greater than the first value.

2. The fuel injection pump according to claim 1, wherein the stay is formed separately from the plate and fixed to the plate.

3. The fuel injection pump according to claim 1, wherein the stay includes a part which is perpendicular to a plane of the plate.

4. The fuel injection pump according to claim 1, wherein
the control lever is formed by punching, and
the adjuster bolt abuts against a shear plane of the control lever.

5. The fuel injection pump according to claim 2, wherein
the control lever is formed by punching, and
the adjuster bolt abuts against a shear plane of the control lever.

6. The fuel injection pump according to claim 3, wherein
the control lever is formed by punching, and
the adjuster bolt abuts against a shear plane of the control lever.

7. The fuel injection pump according to claim 1, wherein the control lever is configured to be operated by a user.

8. The fuel injection pump according to claim 1, wherein the plate is configured to be removably coupled to the body to enable assembly and disassembly of a fuel pressure-feed mechanism that includes the plunger and the plunger barrel.

9. The fuel injection pump according to claim 1, wherein the first value comprises an absolute minimum value of the lower limit.

10. The fuel injection pump according to claim 1, wherein, the adjuster bolt is configured to be adjustable between:
a first position in which turn of the control lever in the rotation direction is restricted by the set bolt; and
a second position in which turn of the control lever in the rotation direction is restricted by the adjuster bolt.

11. The fuel injection pump according to claim 1, wherein:

the set bolt is configured to contact the control lever at a first location on the control lever; and the adjuster bolt is adjustable to contact the control lever at one or more locations of the control lever, each of the one or more locations distinct from the first location.

12. The fuel injection pump according to claim 11, wherein:

an end of the set bolt is configured to contact the control lever at the first location on the control lever; and an end of the adjuster bolt is configured to contact the control lever at the one or more locations of the control lever.

13. The fuel injection pump according to claim 12, wherein the end of the set bolt extends, in a first direction, farther than the end of the adjuster bolt.

14. The fuel injection pump according to claim 12, wherein the control lever is configured to prohibit the end of the adjuster bolt to extend farther than the end of the set bolt in a direction toward the control lever.

15. The fuel injection pump according to claim 12, wherein the first value comprises an absolute minimum value of the lower limit.

16. The fuel injection pump according to claim 1, wherein a position of the set bolt is fixed and non-adjustable.

17. The fuel injection pump according to claim 1, further comprising a nut configured to enable adjustment of the adjuster bolt.

* * * * *